US009283655B2

(12) United States Patent
Olari

(10) Patent No.: US 9,283,655 B2
(45) Date of Patent: Mar. 15, 2016

(54) LIQUID DIFFUSER ADAPTER FOR CENTER FED WET STONE FABRICATION MACHINE

(71) Applicant: Mike Olari, Phoenix, AZ (US)

(72) Inventor: Mike Olari, Phoenix, AZ (US)

( * ) Notice: Subject to any disclaimer, the term of this patent is extended or adjusted under 35 U.S.C. 154(b) by 56 days.

(21) Appl. No.: 14/496,540

(22) Filed: Sep. 25, 2014

(65) Prior Publication Data

US 2015/0093972 A1 Apr. 2, 2015

Related U.S. Application Data

(60) Provisional application No. 61/883,342, filed on Sep. 27, 2013.

(51) Int. Cl.
*B24B 55/02* (2006.01)
*B24B 23/02* (2006.01)

(52) U.S. Cl.
CPC ..... *B24B 55/02* (2013.01); *B24B 23/02* (2013.01); *B24B 23/022* (2013.01); *B24B 23/028* (2013.01)

(58) Field of Classification Search
CPC ..... B24B 55/02; B24B 23/022
USPC ..... 451/450
See application file for complete search history.

(56) References Cited

U.S. PATENT DOCUMENTS

| | | | | | |
|---|---|---|---|---|---|
| 3,345,281 | A * | 10/1967 | Falls | B23H 3/00 | 204/212 |
| 4,570,609 | A * | 2/1986 | Hogue | B23D 59/02 | 125/13.01 |
| 5,022,190 | A * | 6/1991 | Hutchins | B24B 55/02 | 451/357 |
| 6,471,573 | B1 * | 10/2002 | Reitmeyer | B24B 5/00 | 451/446 |
| 8,641,479 | B2 * | 2/2014 | Stephenson | B24B 5/06 | 451/450 |
| 2004/0228701 | A1 * | 11/2004 | Blatz | B23B 31/4073 | 411/190 |
| 2007/0272064 | A1 * | 11/2007 | Kraenzler | B24B 23/022 | 82/160 |
| 2011/0039482 | A1 * | 2/2011 | Timmons | B24B 23/022 | 451/344 |
| 2011/0250827 | A1 * | 10/2011 | Smith | B23D 59/025 | 451/449 |

* cited by examiner

*Primary Examiner* — Lee D Wilson
*Assistant Examiner* — Henry Hong

(57) ABSTRACT

The liquid diffuser adapter is intended to be attached to the arbor wheel of a center fed, wet stone fabrication machine to facilitate dust elimination. The adapter contains a fastener, a plurality of diffusing channels, and a protective coating. The fastener includes a main body, a flange, and a receptive cavity. The flange is concentrically and adjacently connected to the main body. The receptive cavity traverses through the flange and partially into the main body. The receptive cavity contains an opening, a threaded portion, and a hub portion. The threaded portion is used to attach the adapter to the arbor wheel through the opening; the hub portion allows for water to flow into the device and be redirected into the plurality of diffusing channels; the plurality of diffusing channels is radially positioned about the receptive cavity, connecting the hub portion to the exterior environment and thus the cutting disk.

15 Claims, 7 Drawing Sheets

Sectional View A-A

LIQUID DIFFUSER ADAPTER FOR CENTER FED WET STONE FABRICATION MACHINE

The current application claims a priority to the U.S. Provisional Patent application Ser. No. 61/883,342 filed on Sep. 27, 2013.

FIELD OF THE INVENTION

The present invention relates generally to stone fabrication machine accessories and adapters, in particular to center fed stone machines. More specifically, the present invention is a liquid diffuser adaptor for the wheel arbor of a center fed wet stone fabrication machine which utilizes the arbor to deliver water to the grinding disk.

BACKGROUND OF THE INVENTION

As of today, there are approximately 650,000 granite shops in the U.S., out of which, around 40% do not pass the Health Department's minimum requirements for airborne dust elimination. A major natural component of sand, quarts, granite rock, and other similar working material of granite shops/stone fabrication is crystalline silica; which if inhaled in excessive amounts can lead to serious health complications. Grinding, cutting, routing, chipping, polishing, or drilling on granite and other stones which may contain silica can release said mineral into the air resulting in health hazardous conditions for the surrounding workers and personnel. Breathing excessive amounts of crystalline silica can lead to silicosis, a potentially fetal lung disease. Furthermore, personnel with silicosis are more susceptible to other respiratory diseases such as tuberculosis. Worker health concerns have led to the implementation of regulations which control and minimize the amount of airborne dust in stone fabrication shops and similar processes.

Various methods for the reduction of dust have been invented and are currently available for establishments within the industry. One of the methods is the incorporation of ventilation devices into fabrication tools and processes. As can be expected, ventilation devices can only cover a certain amount of area and as such are limited to the amount of the dust that may be captured. Another method is the use of respirators in the work environment; these are effective but require the implementation of respirator programs in each establishment which comprise fit-testing, cleaning, maintenance, supervision, training, and written procedures which result in substantial costs and time commitment. The most effective and popular approach is exposing the dust to water, which binds with and suppresses the dust; this includes using water-fed tools and or the incorporation of water flow at the point of operation.

The existing dust collectors and water-based tools such as grinders and polishers, eliminate approximately 70% of the dust caused by the fabrication. The remaining 30% remain airborne in the production area and can lead to health complications in the surrounding workers and personnel. It is the object of the present invention to introduce an apparatus for eliminating dust produced by center fed based stone fabrication machines. Center fed based machines deliver water to the point of contact through a channel inside the arbor wheel. Traditionally, the water runs from the reservoir, through the wheel arbor, and drips out of the middle region of the cutting wheel to eliminate dust directly at the point of contact. While this may seem highly effective, the design does not take into account various dust particles raised at the sides of the wheel and trapped around the perimeter of the wheel. The present invention acts as a diffuser and redirects the water to all sides of the cutting wheel and in result covers a larger area with water, thus eliminating substantially larger amount of dust when compared to traditional designs.

DETAIL DESCRIPTIONS OF THE INVENTION

All illustrations of the drawings are for the purpose of describing selected versions of the present invention and are not intended to limit the scope of the present invention.

Figure 1:
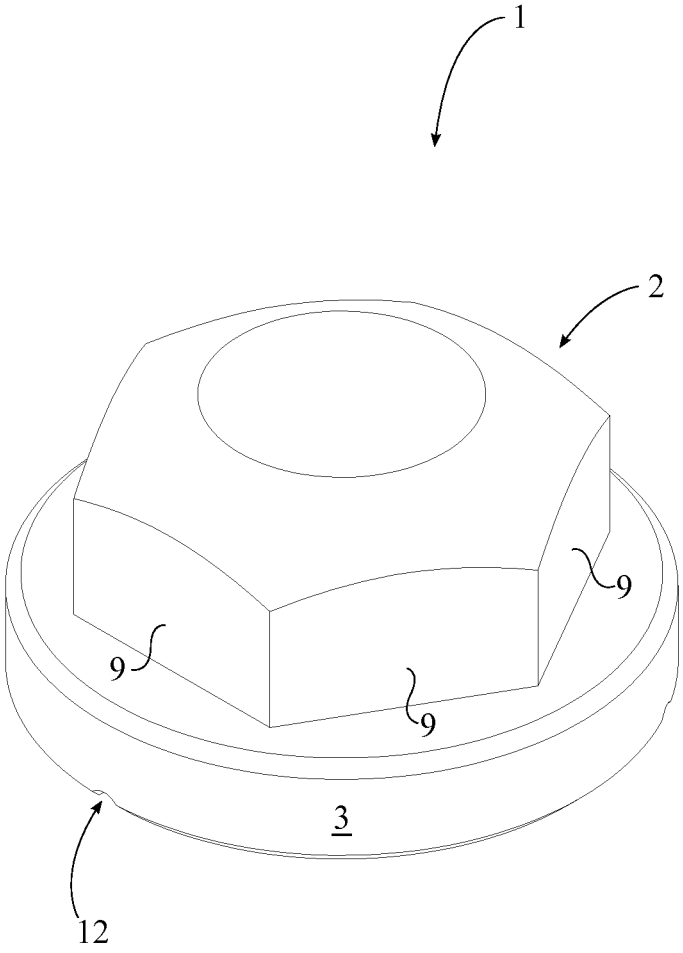
FIG. 1 is a top perspective view of the present invention.
Figure 2:
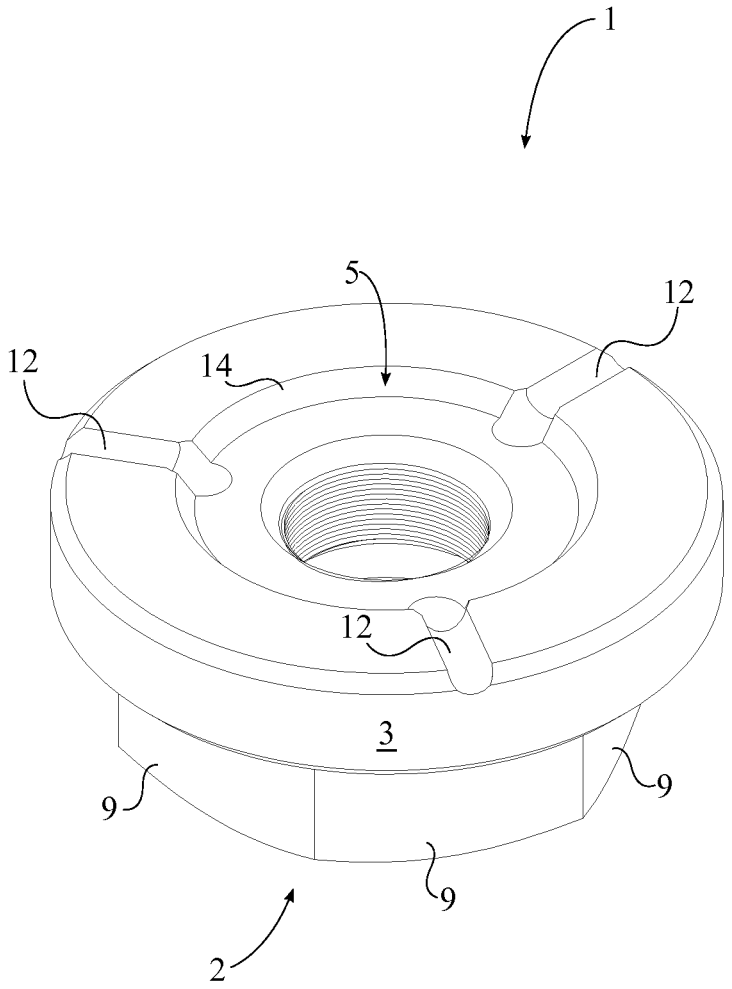
FIG. 2 is a bottom perspective view of the present invention.
Figure 3:
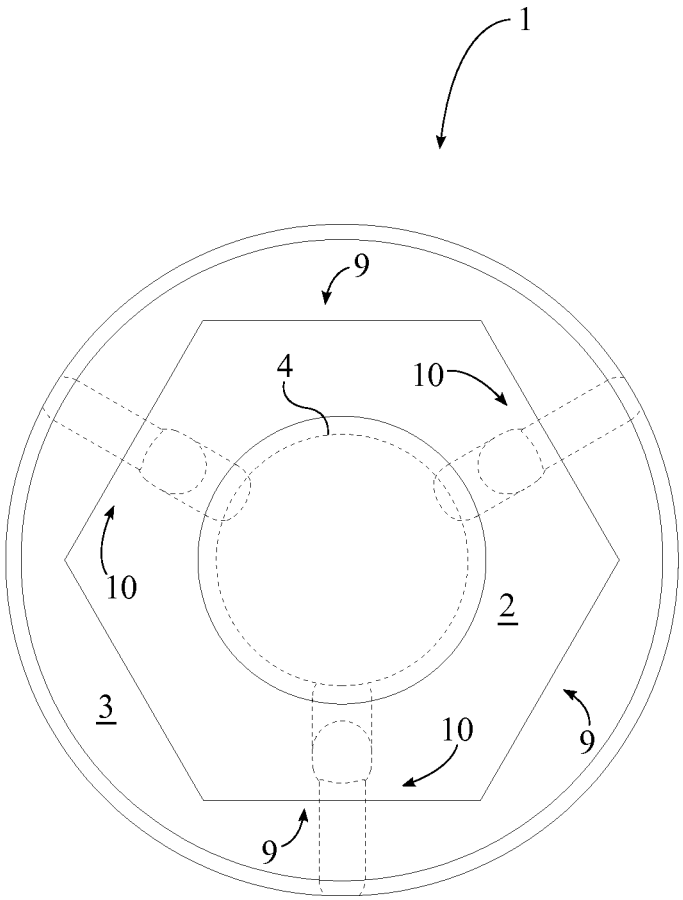
FIG. 3 is a top view of the present invention.
Figure 7:
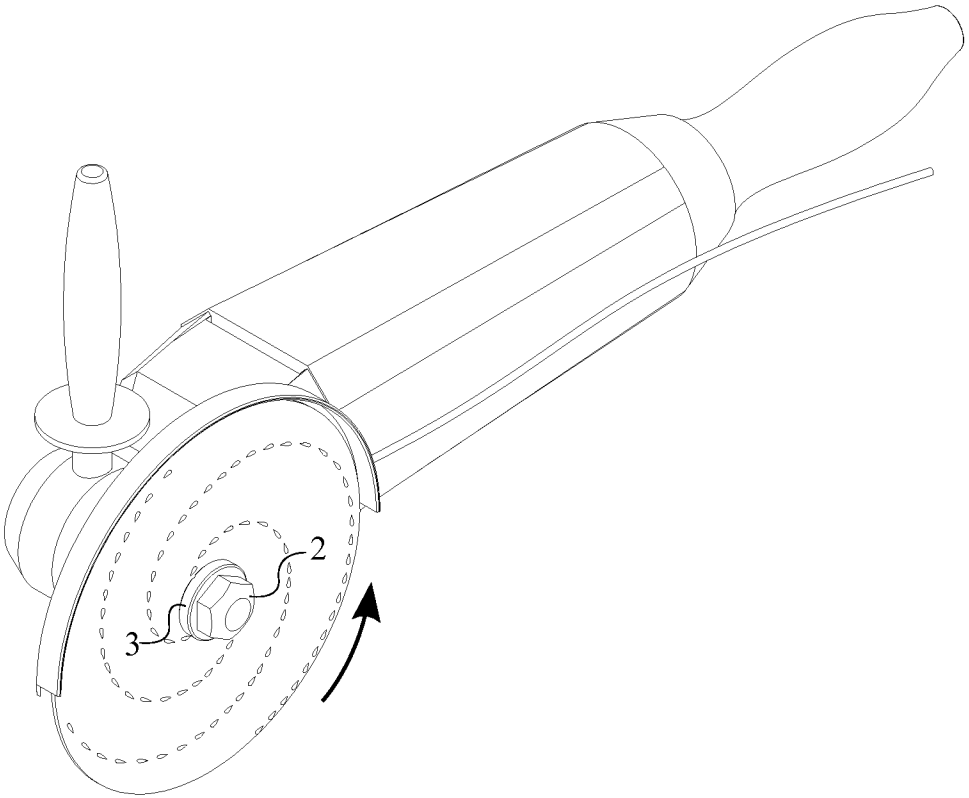
FIG. 7 is a perspective view of the present invention attached to a center fed, wet stone fabrication machine.

As can be seen from FIG. 7, the present invention is an adapter for the wheel arbor of a center fed, wet stone fabrication machine; a stone saw in this particular illustration. The present invention may be modified and adapted for various tools and machines which use a center fed design to deliver liquid to the point of contact with the material; such tools include, but are not limited to, saws, polishers, and grinders. Referring to FIG. 1-FIG. 3, the present invention comprises a fastener 1 and a plurality of diffusing channels 10. The fastener 1 attaches to the shaft of the wheel arbor, adjacent to the cutting or polishing disk such that the disk is rigidly coupled to the wheel arbor as seen in FIG. 7; this design allows the disk to rotate with the wheel arbor. The plurality of diffusing channels 10 traverses through the fastener 1 and redirects the incoming water or liquid to the sides of the disk; the surface area covered by the redirected water is substantially amplified by the centripetal force caused by the rotational motion of the present invention.

Figure 4:
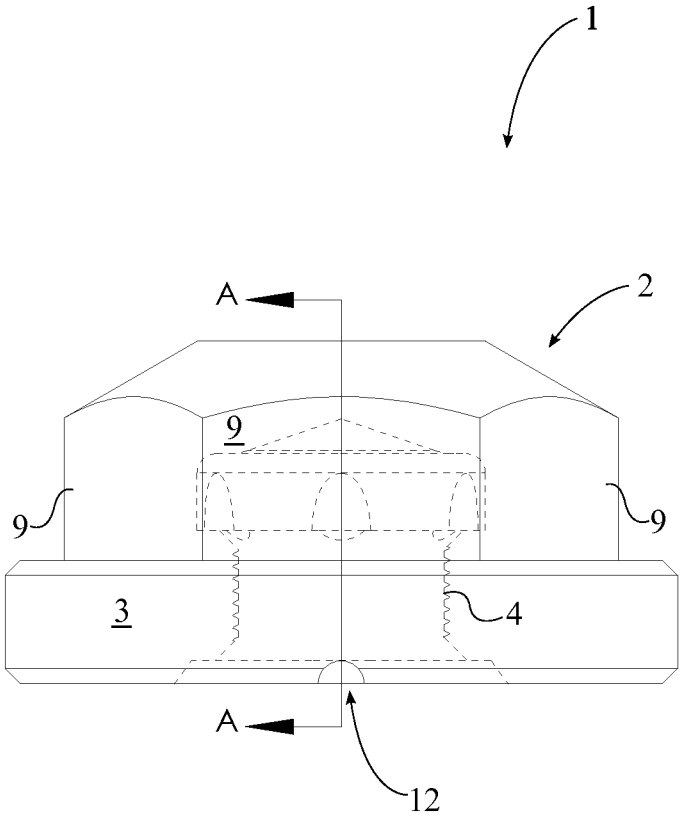
FIG. 4 is a side view of the present invention, showing the plane upon which a cross sectional view is taken shown in FIG. 5.

Referring to FIG. 1 through FIG. 3 the fastener 1 comprises a main body 2, a flange 3, and a receptive cavity 4. The main body 2 is preferably of a cylindrical structure as can be seen in FIG. 1. The flange 3 provides additional strength and supporting area for the fastener 1 to facilitate the attachment of other objects, such as cutting or polishing disks as mention above. The flange 3 is concentrically and adjacently connected to the main body 2 as seen in FIG. 4 and preferably comprises a circular extrusion of a certain length and diameter as seen in FIG. 1. The receptive cavity 4 traverses through the flange 3 and partially into the main body 2; and, is preferably shaped and sized to receive the shaft of the wheel arbor. The receptive cavity 4 comprises an opening 5, a threaded portion 6, and a hub portion 7. The threaded portion 6 is positioned adjacent to the opening 5; the hub portion 7 is positioned adjacent to the threaded portion 6, opposite the opening 5. The present invention is attached to the wheel arbor via complimentary male-female threading on the arbor and receptive cavity 4. The depth of the receptive cavity 4 is such that when the present invention is attached to the wheel arbor, the end of the wheel arbor is located directly adjacent to the hub portion 7; thus the hub portion 7 creates a hollowed space within the main body 2. When the water exits the wheel arbor, it flows directly into the hub portion 7 and is redirected to the plurality of diffusing channels 10.

The plurality of diffusing channels 10 facilitates the flow of water from the hub portion 7 to the external environment and the sides of the disk. The plurality of diffusing channels 10 is radially positioned about the receptive cavity 4 to promote a balanced structure. Each of the plurality of diffusing channels 10 comprises a tunnel 11 and a groove 12. The tunnel 11 traverses out of the hub portion 7, through the main body 2, and into the flange 3 to connect to the groove 12. The groove 12 is embedded into the flange 3, opposite to the main body 2 such that when the present invention is installed onto the wheel arbor the groove 12 is pressed against the disk. The groove 12 is orientated and positioned such that the groove 12 laterally traverses from the tunnel 11 and out of the flange 3 to the exterior environment.

In some embodiments, the receptive cavity 4 further comprises a cone-shaped portion 8 which further redirects and facilitates the flow of water into the plurality of diffusing channels 10. The cone-shaped portion 8 is positioned adjacent to the hub portion 7, opposite the threaded portion 6; the cone-shaped portion 8 is also concentrically positioned with the hub portion 7. In traditional center fed designs, the water simply drips from the center of the wheel arbor and only covers a small region. With the present invention, the water enters the hub portion 7, hits the cone-shaped portion 8 and is angled to the plurality of diffusing channels 10 where it travels through the tunnel 11 and to the groove 12 that leads to the external environment. Each of the plurality of diffusing channels 10 leads to a different region of the fastener 1 and thus the water flowing through the plurality of diffusing channels 10 covers a larger area than traditional designs. Additionally, the area covered by the present invention is amplified by the rotational motion of the disk as seen in FIG. 7.

In some embodiments, the present invention further comprises an annular recessed space 14. The annular recessed space 14 is embedded into the flange 3 and facilitates equal fluid distribution as the water flowing through the plurality of diffusing channels 10 transitions from the tunnels 11 to the grooves 12; the annular recessed space 14 is especially useful in case one or more grooves 12 become clogged. The annular recessed space 14 is concentrically positioned to the threaded portion 6 such that the tunnel 11 of each of the plurality of diffusing channels 10 traverses into the annular recessed space 14. Additionally, the annular recessed space 14 is large enough that the groove 12 for each of the plurality of diffusing channels 10 traverses out of the annular recessed space 14.

The fastener 1 further comprises a plurality of tool-attachment features 9 which aid the user during the installation process. The plurality of tool-attachment features 9 is radially positioned about the main body 2. In some embodiments, each of the plurality of tool-attachment features 9 is a flat surface such that the plurality of tool-attachment features 9 forms a hexagonal outline when viewed from the top perspective as seen in FIG. 3. The hexagonal outline allows the user to utilize a simple wrench for the installation process.

Figure 5:
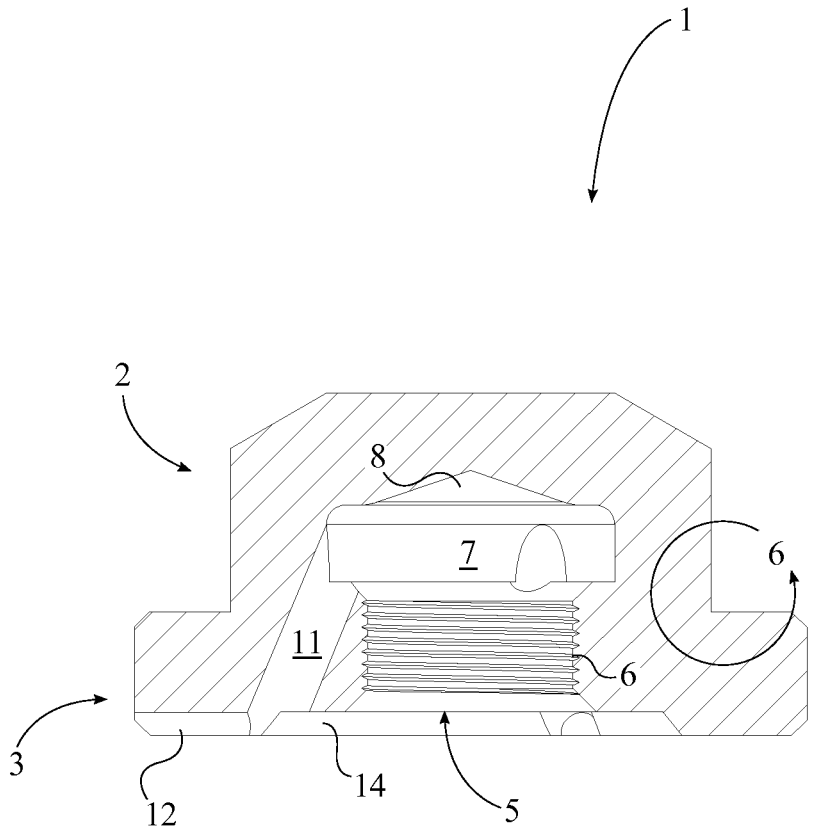
FIG. 5 is a cross-sectional view of the present invention taken along line A-A of FIG. 4.
Figure 6:
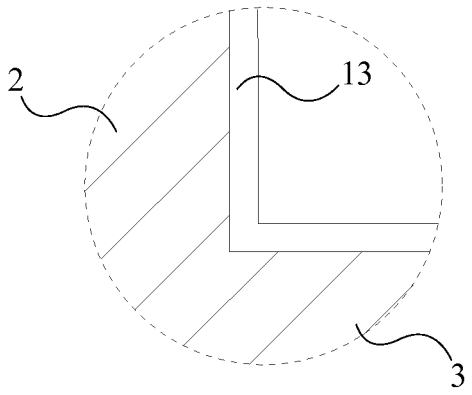
FIG. 6 is a detailed view of the cross-sectional view of the present invention.

The present invention further comprises a protective coating 13. The protective coating 13 is preferably made of anodized composition and is superimposed over the main body 2 and the flange 3 as seen in FIG. 5 and FIG. 6. The protective coating 13 increases corrosion resistance as well as wear resistance to ensure a long service life. The color scheme, pattern scheme, size, shape, and other similar characteristics are subject to change.

Although the invention has been explained in relation to its preferred embodiment, it is to be understood that many other possible modifications and variations can be made without departing from the spirit and scope of the invention as hereinafter claimed.

What is claimed is:

1. A liquid diffuser adapter for center fed wet stone grinders comprises:
- a fastener;
- a plurality of diffusing channels;
- the fastener comprises an main body, a flange, and a receptive cavity;
- each of the plurality of diffusing channels comprises a tunnel and a groove;
- the receptive cavity comprises an opening, a threaded portion, and a hub portion;
- the flange being concentrically and adjacently connected to the main body;
- the receptive cavity traversing through the flange and traversing into the main body;
- the threaded portion being positioned adjacent to the opening;
- the hub portion being positioned adjacent to threaded portion, opposite to the opening;
- the plurality of diffusing channels being radially positioned about the receptive cavity;
- the tunnel traversing out of the hub portion, traversing through the main body, and traversing into the flange;
- the groove being embedded into the flange, opposite to the main body;
- the groove laterally traversing from the tunnel and out of the flange;
- the receptive cavity further comprises a cone-shaped portion;
- the cone-shaped portion being positioned adjacent to the hub portion, opposite the threaded portion; and
- the cone-shaped portion being concentrically positioned with the hub portion.

2. The liquid diffuser adapter for center fed wet stone grinders as claimed in claim 1 comprises:
- a protective coating; and
- the protective coating being superimposed over the main body and the flange.

3. The liquid diffuser adapter for center fed wet stone grinders as claimed in claim 2 comprises:
- the protective coating being made of an anodized composition.

4. The liquid diffuser adapter for center fed wet stone grinders as claimed in claim 1 comprises:
- the fastener further comprises a plurality of tool-attachment features; and
- the plurality of tool-attachment features being radially positioned about the main body.

5. The liquid diffuser adapter for center fed wet stone grinders as claimed in claim 4 comprises:
- each of the plurality of tool-attachment features being a flat surface; and
- the plurality of tool-attachment features forming a hexagonal outline.

6. The liquid diffuser adapter for center fed wet stone grinders as claimed in claim 1 comprises:
- an annular recessed space;
- the annular recessed space being embedded into the flange;
- the annular recessed space being concentrically positioned to the threaded portion;
- the tunnel for each of the plurality of diffusing channels traversing into the annular recessed space; and
- the groove for each of the plurality of diffusing channels traversing out of the annular recessed space.

7. A liquid diffuser adapter for center fed wet stone grinders comprises:

a fastener;

a plurality of diffusing channels;

the fastener comprises an main body, a flange, and a receptive cavity;

each of the plurality of diffusing channels comprises a tunnel and a groove;

the receptive cavity comprises an opening, a threaded portion, and a hub portion;

the flange being concentrically and adjacently connected to the main body;

the receptive cavity traversing through the flange and traversing into the main body;

the threaded portion being positioned adjacent to the opening;

the hub portion being positioned adjacent to threaded portion, opposite to the opening;

the plurality of diffusing channels being radially positioned about the receptive cavity;

the tunnel traversing out of the hub portion, traversing through the main body, and traversing into the flange;

the groove being embedded into the flange, opposite to the main body;

the groove laterally traversing from the tunnel and out of the flange;

the fastener further comprises a plurality of tool-attachment features;

the plurality of tool-attachment features being radially positioned about the main body;

the receptive cavity further comprises a cone-shaped portion;

the cone-shaped portion being positioned adjacent to the hub portion, opposite the threaded portion; and the cone-shaped portion being concentrically positioned with the hub portion.

8. The liquid diffuser adapter for center fed wet stone grinders as claimed in claim 7 comprises:

a protective coating; and the protective coating being superimposed over the main body and the flange.

9. The liquid diffuser adapter for center fed wet stone grinders as claimed in claim 8 comprises:

the protective coating being made of an anodized composition.

10. The liquid diffuser adapter for center fed wet stone grinders as claimed in claim 7 comprises:

each of the plurality of tool-attachment features being a flat surface; and the plurality of tool-attachment features forming a hexagonal outline.

11. The liquid diffuser adapter for center fed wet stone grinders as claimed in claim 7 comprises:

an annular recessed space;

the annular recessed space being embedded into the flange;

the annular recessed space being concentrically positioned to the threaded portion;

the tunnel for each of the plurality of diffusing channels traversing into the annular recessed space; and the groove for each of the plurality of diffusing channels traversing out of the annular recessed space.

12. A liquid diffuser adapter for center fed wet stone grinders comprises:

a fastener;

a plurality of diffusing channels;

a protective coating;

the fastener comprises an main body, a flange, and a receptive cavity;

each of the plurality of diffusing channels comprises a tunnel and a groove;

the receptive cavity comprises an opening, a threaded portion, and a hub portion;

the flange being concentrically and adjacently connected to the main body;

the receptive cavity traversing through the flange and traversing into the main body;

the threaded portion being positioned adjacent to the opening;

the hub portion being positioned adjacent to threaded portion, opposite to the opening;

the plurality of diffusing channels being radially positioned about the receptive cavity;

the tunnel traversing out of the hub portion, traversing through the main body, and traversing into the flange;

the groove being embedded into the flange, opposite to the main body;

the groove laterally traversing from the tunnel and out of the flange;

the fastener further comprises a plurality of tool-attachment features;

the plurality of tool-attachment features being radially positioned about the main body;

the protective coating being superimposed over the main body and the flange;

the receptive cavity further comprises a cone-shaped portion;

the cone-shaped portion being positioned adjacent to the hub portion, opposite the threaded portion; and the cone-shaped portion being concentrically positioned with the hub portion.

13. The liquid diffuser adapter for center fed wet stone grinders as claimed in claim 12 comprises:

the protective coating being made of an anodized composition.

14. The liquid diffuser adapter for center fed wet stone grinders as claimed in claim 12 comprises:

each of the plurality of tool-attachment features being a flat surface; and the plurality of tool-attachment features forming a hexagonal outline.

15. The liquid diffuser adapter for center fed wet stone grinders as claimed in claim 12 comprises:

an annular recessed space;

the annular recessed space being embedded into the flange;

the annular recessed space being concentrically positioned to the threaded portion;

the tunnel for each of the plurality of diffusing channels traversing into the annular recessed space; and the groove for each of the plurality of diffusing channels traversing out of the annular recessed space.

* * * * *